US006477750B2

(12) United States Patent
Okawa et al.

(10) Patent No.: US 6,477,750 B2
(45) Date of Patent: Nov. 12, 2002

(54) SURFACE FASTENER

(75) Inventors: Mitsuhisa Okawa, Toyama-ken (JP); Norinaka Hirokawa, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/790,569

(22) Filed: Feb. 23, 2001

(65) Prior Publication Data

US 2001/0016972 A1 Aug. 30, 2001

(30) Foreign Application Priority Data

Feb. 29, 2000 (JP) ..... 2000-053960

(51) Int. Cl.[7] ..... A44B 18/00
(52) U.S. Cl. ..... 24/445; 24/446
(58) Field of Search ..... 24/445, 442, 306, 24/451, 446, 448; 428/99

(56) References Cited

U.S. PATENT DOCUMENTS

| | | | | |
|---|---|---|---|---|
| 3,594,873 A | | 7/1971 | Hockmeyer et al. | |
| 3,643,316 A | * | 2/1972 | Girard et al. | 148/516 |
| 3,943,981 A | * | 3/1976 | De Brabander | |
| 4,853,070 A | * | 8/1989 | Erb et al. | 156/436 |
| 5,032,122 A | * | 7/1991 | Noel et al. | 604/391 |
| 5,349,991 A | * | 9/1994 | Okawa et al. | 139/391 |
| 5,647,864 A | * | 7/1997 | Allen et al. | 604/391 |
| 5,659,930 A | * | 8/1997 | Okawa | 24/445 |
| 5,852,855 A | * | 12/1998 | Mody et al. | 24/445 |
| 5,974,635 A | * | 11/1999 | Murasaki | 24/446 |
| 6,202,264 B1 | * | 3/2001 | Ishihara | 24/445 |

FOREIGN PATENT DOCUMENTS

| | | |
|---|---|---|
| EP | 0604869 | 7/1994 |
| EP | 0682888 | 12/1995 |
| JP | 2593380 | 5/1999 |
| JP | 11244010 | 9/1999 |

* cited by examiner

*Primary Examiner*—Robert J. Sandy
(74) *Attorney, Agent, or Firm*—Finnegan, Henderson, Farabow, Garrett & Dunner, LLP

(57) ABSTRACT

The present invention provides a surface fastener having a high durability, in which an engaging element yarn for forming loop-like or hook-like engaging elements is fixed firmly to a foundation fabric in a simple configuration. In a surface fastener foundation fabric woven with warps and wefts, the engaging element yarns for forming the loop-like, hook-like or mushroom-like engaging elements are woven into the foundation fabric at a predetermined interval, and cross-woven warps are woven with the engaging element yarns to fix the engaging element yarns to the foundation fabric at before and after each of loop portions of the engaging element yarns. Further, warps of thermal melting yarns are used as the cross-woven warps which are melted so that the engaging element yarns may be welded to the foundation fabric. Consequently, a surface fastener having good feeling and is excellent in strength and flexibility is obtained.

7 Claims, 3 Drawing Sheets

SURFACE FASTENER

BACKGROUND OF THE INVENTION

1. Field of the Invention

The present invention relates to a surface fastener in which engaging element yarns thereof are woven into a foundation fabric woven with warps and wefts and warps to be cross-woven are woven with the engaging element yarns so as to fix the engaging element yarns to the foundation fabric and more particularly to a surface fastener in which the engaging element yarns are fixed to the foundation fabric using thermal melting yarns so as to make the fastener stronger. In this invention, the warp to be cross-woven with the engaging element yarn is called "cross-woven warp".

2. Description of the Related Art

Conventionally, it was not known that an engaging element yarn for forming loop-like engaging elements or hook-like engaging elements could be fixed to a foundation fabric by means of a cross-woven warp in the surface fastener. Instead, it was well known that the engaging element yarn was fixed by applying so-called back coating method or coating an entire rear face of the woven foundation fabric with thermoplastic resin such as polyester or polyurethane in order to produce a strong surface fastener by fixing the engaging element yarns into the foundation fabric woven with warps and wefts so as to fix the engaging element yarns to the foundation fabric firmly or prevent warps at a cut end from fraying when the surface fastener is cut to a predetermined width. These arts have been disclosed in, for example, Japanese Patent Laid-Open Publication No.11-244010 and Japanese Utility Model No. 2593380.

In the aforementioned well known surface fasteners, the engaging element yarns for forming the loop-like engaging elements or hook-like engaging elements are woven into the foundation fabric woven with the warps and wefts. Then, the entire rear surface of the woven foundation fabric is coated with thermoplastic resin such as polyester or polyurethane. As a result, the foundation fabric of a finished surface fastener is tensed strongly lacking flexibility. Even if thin resin film existing between weaving yarns of the foundation fabric is broken by blowing air through an air nozzle after the back coating is applied, a surface fastener of good-feeling is not produced. Further, selection of resin and coating control for applying the back coating are not only troublesome but also induces an increase of production cost.

SUMMARY OF THE INVENTION

The present invention has been achieved considering the above described problems. An object of a main aspect of the invention is to provide a good-feeling, high quality surface fastener having a durability and flexibility, in which engaging element yarns for forming loop-like engaging elements, hook-like engaging elements or mushroom-like engaging elements are fixed firmly to a foundation fabric through a simple configuration, this surface fastener being easy to produce at low cost.

Another object of the invention is to provide a surface fastener in which cross-woven warps are cross-woven accurately with engaging element yarns so as to fix the engaging elements to the foundation fabric easily.

Another object of the invention is to provide a good-feeling surface fastener in which thermal melting yarns having melting point lower than other yarns, as the cross-woven warps, are cross-woven with the engaging element yarns for forming the engaging elements and the thermal melting yarns are welded so as to fix portions of the engaging elements yarns intersecting the foundation fabric, the surface fastener being easy to produce.

Another object of the invention is to provide a good-feeling surface fastener in which the cross-woven warps are cross-woven with the engaging element yarns for forming the engaging elements and thermal melting yarns are woven as warps adjacent to these yarns and the thermal melting yarns are welded so as to fix the portions of the engaging element yarns intersecting the foundation fabric, the surface fastener being easy to produce.

Another object of the invention is to provide a good-feeling surface fastener in which material and configuration of the thermal melting yarns for use in fixing the engaging element yarns for forming the engaging elements to the foundation fabric are specified so that the engaging element yarns are fixed to the foundation fabric by using various kinds of the thermal melting yarns each.

To achieve the above described object, according to the main aspect of the invention, there is provided a surface fastener woven with the warps and wefts, in which the engaging element yarn for forming the engaging elements is woven into the foundation fabric and the cross-woven warp is cross-woven with the engaging element yarn so that the engaging element yarn is woven in and fixed to the foundation fabric, at portions where the engaging element yarn intersects the foundation fabric 1, that is, at woven points with the cross-woven warp. Consequently, the engaging element yarn can be fixed to the foundation fabric easily by means of the cross-woven warp woven with the engaging element yarn for forming the loop-like engaging elements or hook-like engaging elements. Thus, a good-feeling surface fastener having excellent strength and flexibility is produced at low cost.

Preferably, the cross-woven warp is cross-woven with the engaging element yarn at before and after the engaging element. Consequently, the cross-woven warp is used effectively as being cross-woven with the engaging element yarn so that the loop portion for the engaging element can be fixed to the foundation fabric easily and accurately.

Preferably, a thermal melting yarn having thermal melting point lower than other constituent yarns is used as the cross-woven warp and the cross-woven warp is cross-woven with the engaging element yarn and welded so as to fix the engaging element yarn to the foundation fabric at the portions where the engaging element yarn intersects the foundation fabric, that is, at the woven points with the cross-woven warp. Consequently, because the thermal melting yarn is used as the cross-woven warp, the engaging element yarn can be welded and fixed to the foundation fabric accurately and strongly.

Also preferably, the cross-woven warp is cross-woven with the engaging element yarn and the thermal melting yarn is woven as the warp and welded adjacently to the yarn and warp so as to fix the engaging element yarn to the foundation fabric at the portions where the engaging element yarn intersects the foundation fabric, that is, at the woven points with the cross-woven warp. Consequently, the engaging element yarn is fixed strongly by the cross-woven warp and cross-woven portion is welded and fixed by the thermal melting yarn woven adjacently. Thus, a strong, good-feeling surface fastener can be obtained.

Further preferably, as the thermal melting yarn, composite yarn in which synthetic fiber having a low melting point and synthetic fiber having a high melting point are arranged in parallel or mixed with each other is used, or a mixed yarn in which fiber difficult to melt by heat and fiber capable of being melted by heat are mixed is used, or a coated yarn comprised of a core yarn produced from a fiber having a high melting point or fiber difficult to melt by heat and coating film of thermoplastic resin having a thermal melting point lower than the core yarn provided around the core yarn is used, respectively. Each of these yarns is woven aside the engaging element yarn and melted so as to fix the engaging element yarn to the foundation fabric at the portions where the engaging element yarn intersects the foundation fabric, that is, at the woven points with the cross-woven warp. Thus, various types of the thermal melting yarns can be used, and because the thermal melting yarn is melted partly and part thereof remains, the engaging element yarn is not only fixed firmly to the foundation yarn but also welded to the foundation fabric. Therefore, two functions can be exerted and a reinforced surface fastener can be produced easily.

DESCRIPTION OF THE PREFERRED EMBODIMENTS

Hereinafter, embodiments of the surface fastener of the present invention will be described in detail with reference to the accompanying drawings.

Figure 1:
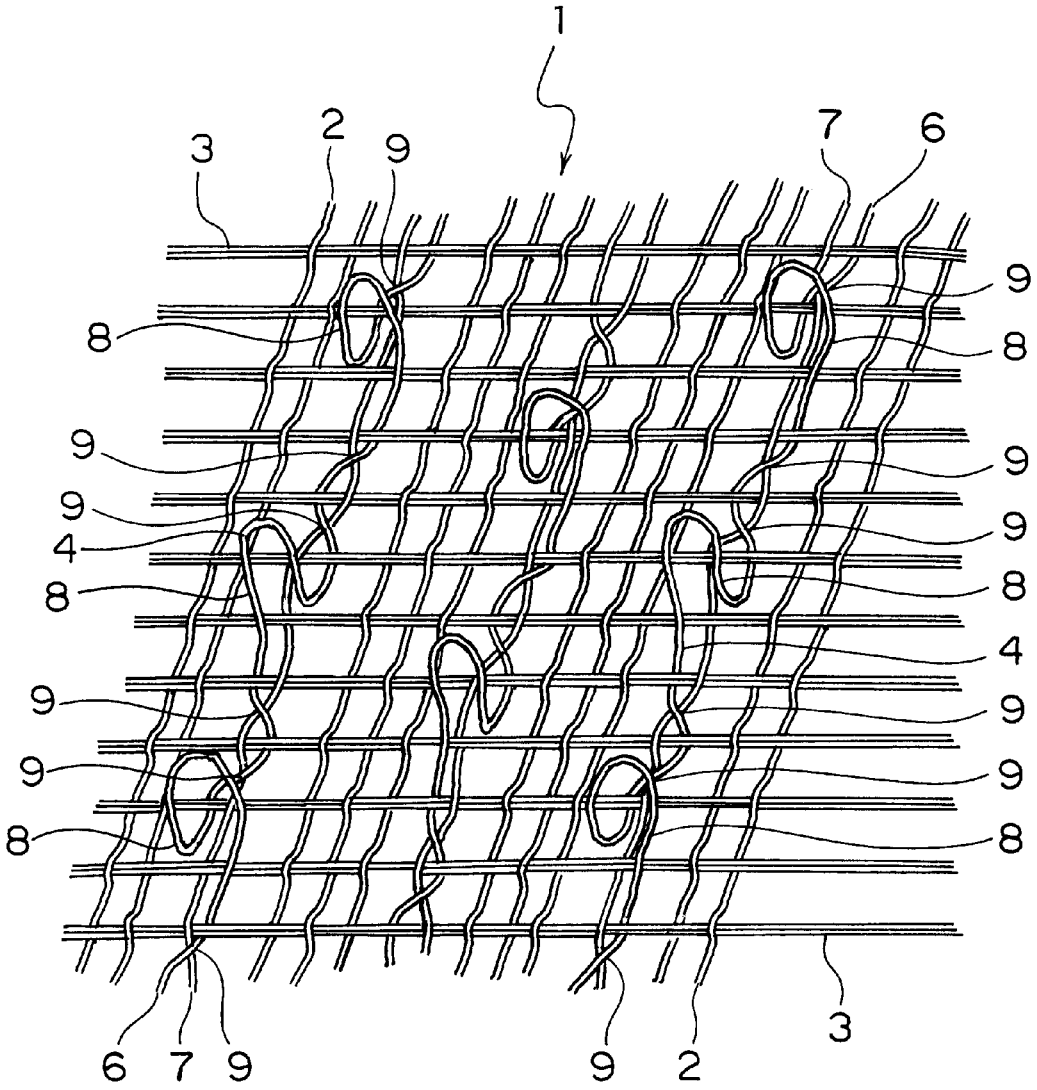
FIG. 1 is a perspective view showing a state in which engaging element yarns for loop-like elements and cross-woven warps are combined.
Figure 2:
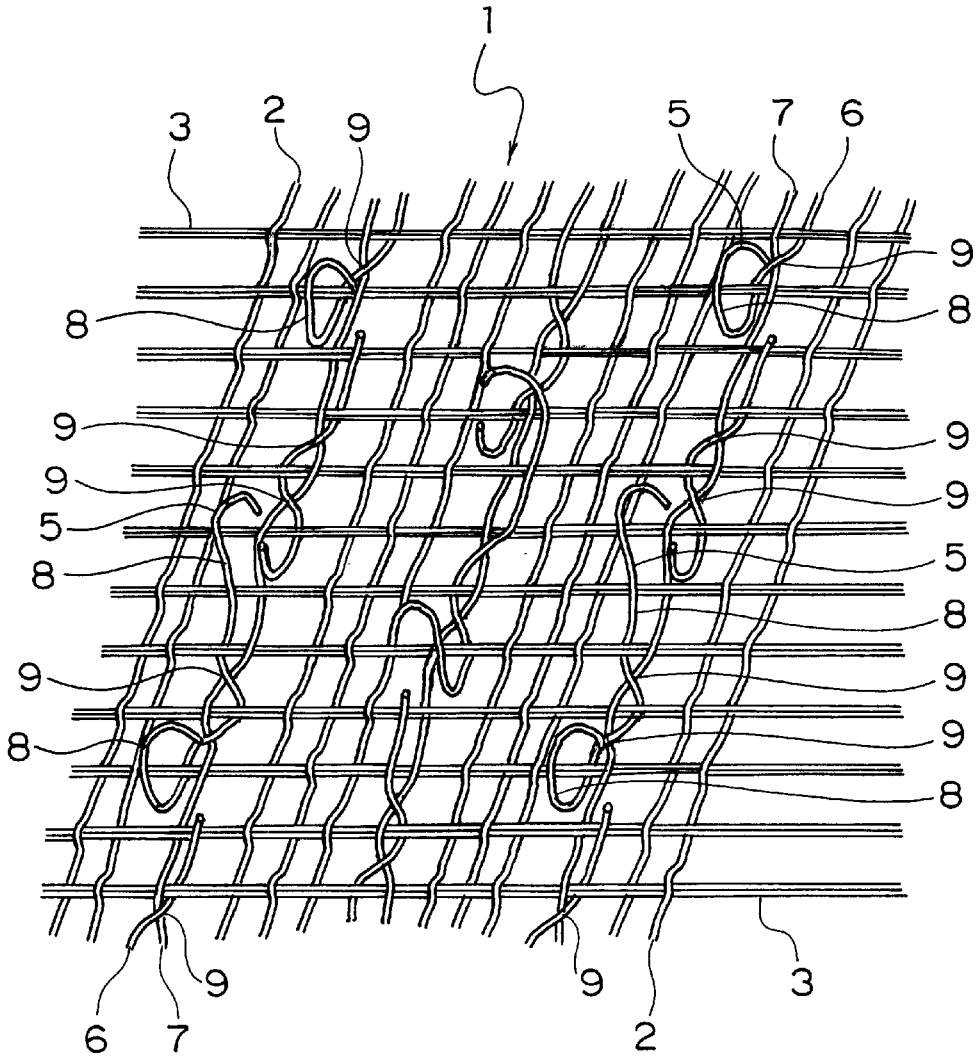
FIG. 2 is a perspective view showing a state in which engaging element yarns for hook-like elements and cross-woven warps are combined.

According to the surface fastener of the present invention, a surface fastener shown in FIG. 1 has loop-like engaging elements 4 and a surface fastener shown in FIG. 2 has hook-like engaging elements 5. First, a surface fastener with the loop-like engaging elements 4 shown in FIG. 1 will be described. A foundation fabric 1 of the surface fastener is woven with warps 2 and wefts 3 by a weaving means and then, engaging element yarns 6 are woven into this foundation fabric in order to form loop-like engaging elements 4 for a surface fastener in this foundation fabric 1. The foundation fabric 1 is woven with the warp 2 made by needle weaving and the weft 3 of double pick. The warp 2 and weft 3 of the foundation fabric 1 is formed of multi-filament of synthetic fiber of polyamide base, polyester base or polypropylene base.

The engaging element yarn 6 is also formed of multi-filament of synthetic fiber of polyamide base, polyester base or polypropylene base like the warp 2 and weft 3 of the foundation fabric 1. Whether the same base synthetic resin or a different base synthetic resin is used for the engaging element yarn 6, warp 2 and weft 3 is selectable appropriately depending on its purpose. The engaging element yarn 6 is woven in the foundation fabric 1 such that loop portions 8 formed as the loop-like engaging elements 4 are disposed to stand at a predetermined interval. Therefore, in FIG. 1, the loop portion 8 is formed every four wefts 3 of double pick. However, the interval of the weft yarns 3 may be changed appropriately. Further, the engaging element yarn 6 is cross-woven integrally with the cross-woven warp 7 and weft 3 at the wefts 3 before and after the loop portion 8.

Therefore, the loop portion 8 of the engaging element yarn 6 to form the loop-like engaging element 4 is fixed firmly by cross-weaving the cross-woven warp 7 with the weft 3, that is foundation fabric 1, before and after the loop portion 8. Consequently, a stabilized structure in which the loop portion 8 is never deviated is formed so that an excellent quality surface fastener can be finished.

This cross-woven warp 7 is formed of multi-filament of synthetic fiber of polyamide base, polyester base or polypropylene base like the engaging element yarn 6 or warp 2 and weft 3 of the foundation fabric 1. Whether synthetic fiber of the same base as or different base from the engaging element yarn 6 or warp 2 and weft 3 is employed for the cross-woven warp 7 is selectable appropriately depending on the purpose. Preferably, synthetic fiber having a thermal melting point lower than the warp 2 and weft 3 composing the foundation fabric 1 is used as the cross-woven warp 7. For example, polyamide base nylon 66 fiber is used for the warp 2 and weft 3 forming the foundation fabric 1 and nylon 6 fiber having a thermal melting point lower than the nylon 66 fiber is used for the cross-woven warp 7. Consequently, the cross-woven warp 7 is melted at low temperatures so that the engaging element yarn 6 and weft 3 and cross-woven warp 7 are welded with each other. Any synthetic fiber of polyamide copolymer or polyester copolymer as synthetic fiber having a low thermal melting point may also be used. The engaging element yarn 6 is welded with the wefts 3 before and after the loop portion 8 of the engaging element yarn 6. By napping or brushing the loop portions 8 of the engaging element yarns 6 fixed to the foundation fabric 1, the loop-like engaging elements 4 are formed so as to finish the fastener with the loop-like elements 4. As a result, a strong surface fastener is obtained.

Next, a surface fastener with the hook-like engaging elements 5 shown in FIG. 2 will be described. The foundation fabric 1 is of the same configuration as the foundation fabric 1 of the surface fastener with the loop-like engaging elements 4 of the foregoing embodiment. The foundation fabric 1 is woven with the warps 2 made by needle weaving and the wefts 3 of double pick. The warps 2 and wefts 3 of the foundation fabric 1 are formed of multi-filament of synthetic fiber of polyamide base, polyester base or polypropylene base.

The engaging element yarn 6 is formed of mono-filament which is made of synthetic fiber of polyamide base, polyester base, polypropylene base like the warp yarn 2 and weft yarn 3 of the foundation fabric 1. Whether synthetic fiber of the same base as or different base is used for the engaging element yarn 6 and the warp 2 and weft 3 is selectable appropriately depending on the purpose. The engaging element yarn 6 is woven in the foundation fabric 1 such that loop portions 8 formed as the hook-like engaging element 5 are disposed to stand at a predetermined interval. Therefore, in FIG. 2, the loop portion 8 is formed every four wefts 3 of double pick. However, the interval of the wefts 3 may be changed appropriately. Further, the engaging element yarn 6 is cross-woven integrally with the cross-woven warp 7 and weft 3 at the wefts 3 before and after the loop portion 8.

Therefore, in this case also, the loop portion 8 of the engaging element yarn 6 to form the hook-like engaging element 5 is fixed firmly by cross-weaving the cross-woven warp 7 with the weft 3, that is foundation fabric 1, before and after the loop portion 8. Consequently, a stabilized structure in which the loop portion 8 is never deviated is formed, so that an excellent quality surface fastener can be finished.

This cross-woven warp 7 is formed of multi-filament of synthetic fiber of polyamide base, polyester base or polypropylene base like the engaging element yarn 6 or warp 2 and weft 3 of the foundation fabric 1. Whether synthetic fiber of the same base as or different base from the engaging element yarn 6 or warp 2 and weft 3 is employed for the cross-woven warp 7 is selectable appropriately depending on the purpose. Preferably, synthetic fiber having a thermal melting point lower than the warp 2 and weft 3 composing the foundation fabric 1 is used as the cross-woven warp 7. For example, nylon 66 fiber is used for the warp yarn 2 and weft yarn 3 forming the foundation fabric 1 and nylon 6 fiber is used as the cross-woven warp 7. By melting the cross-woven warp 7 having the lower thermal melting point by heat, the engaging element yarn 6, weft 3 and cross-woven warp 7 are welded with each other. Any synthetic fiber of polyamide copolymer or polyester copolymer as synthetic fiber having a low thermal melting point may also be used. The engaging element yarn 6 is welded to be fixed with the wefts 3 before and after the loop portion 8 of the engaging element yarn 6. By cutting one side of the loop portion 8 of the engaging element yarns 6 fixed to the foundation fabric 1, the hook-like engaging elements 5 is formed so as to finish the fastener with the hook-like engaging elements 5. As a result, a strong surface fastener is obtained.

A surface fastener with the mushroom-like engaging elements may be finished by welding a cut end of a top portion of the loop portion 8 of the engaging element yarn 6 by heat, so as to form an end portion in an expanded shape thereby forming a mushroom-like engaging element.

Figure 3:
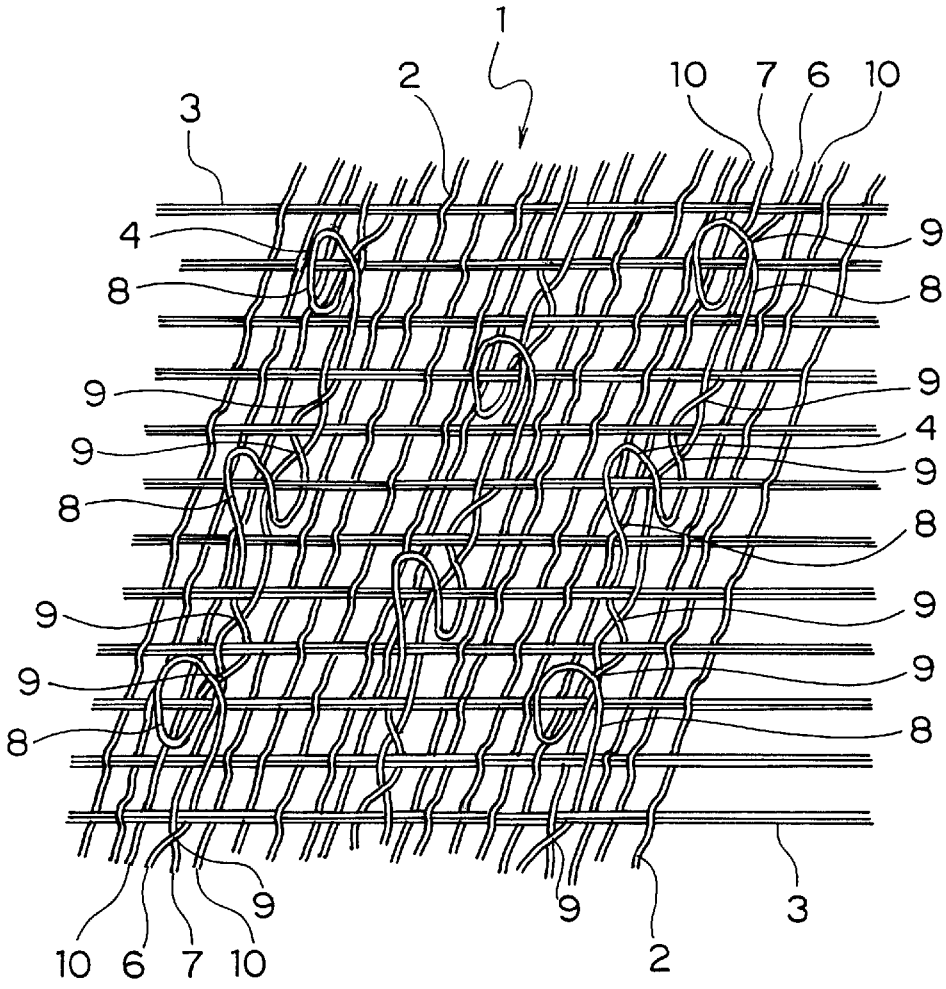
FIG. 3 is a perspective view showing a state in which engaging element yarns for loop-like elements, cross-woven warps and thermal melting yarns are combined.

The foundation fabric 1 of the surface fastener shown in FIG. 3 is slightly different in terms of configuration from those shown in FIGS. 1 and 2. The foundation fabric 1 is woven with the warps 2 made by needle weaving and the wefts 3 of double pick. The engaging element yarns 6 for forming the loop-like engaging elements 4 are disposed in the foundation fabric 1 at a predetermined interval in a width direction and the loop portions 8 are formed every four wefts like the preceding embodiments. The engaging element yarn 6 is cross-woven with each of the wefts 3 before and after the loop portion 8 by the cross-woven warp 7. The warp 2, weft 3, engaging element yarn 6 and the cross-woven warp 7 are formed of multi-filament of synthetic fiber of polyamide base, polyester base or polypropylene base. Whether synthetic fiber of the same base as or different base is employed for each yarn is selectable appropriately depending on the purpose.

In the foundation structure of the foundation fabric 1 described above, thermal melting yarn is woven as a warp 10 on both sides of the cross-woven warp 7 cross-woven with the engaging element yarn 6. The thermal melting yarn woven as the warp 10 intersects the wefts 3 of double pick at an appropriate interval. For example, in FIG. 3, the warp 10 is woven in the foundation structure such that it goes over the weft 3 on which the loop portion 8 of the engaging element yarn 6 is formed and goes under other three wefts 3.

The warp 10 is formed of multi-filament or mono-filament of synthetic fiber having a thermal melting point lower than the warp 2, weft 3, engaging element yarn 6 and cross-woven warp 7. When this warp 10 is melted by heat together with the cross-woven warp 7, the engaging element yarn 6 is welded and fixed to the weft 3 together with the cross-woven warp 7 located before and after the loop portions 8 of the engaging element yarn 6. Therefore, the engaging element yarn 6 can be fixed to the foundation fabric 1 more firmly than the preceding embodiments.

The loop portion 8 of the engaging element yarn 6 fixed to the foundation fabric 1 is napped so as to form the loop-like engaging element 4, thereby providing the surface fastener with the loop-like engaging elements 4. Meanwhile, the surface fastener having the hook-like engaging element 5 is completely the same as the above described surface fastener with the loop-like engaging elements 4 except that mono-filament of synthetic fiber is used for the engaging element yarn 6 for forming the hook-like engaging element 5 to be woven into the foundation fabric 1. By cutting one side of the loop portion 8 of the woven engaging element yarn 6, the hook-like engaging element 5 is formed, so that the surface fastener with the hook-like engaging elements 5 is obtained.

Finally, the configuration of the thermal melting yarn for use in the surface fastener will be described. The thermal melting yarn may be a single yarn of synthetic fiber having a melting point lower than the warp 2 and weft 3 of the foundation fabric 1 and the engaging element yarn 6 according to the above described embodiment. Alternatively, the thermal melting yarn may be formed by combining synthetic fiber having a low melting point with synthetic fiber having a high melting point such that they are arranged in parallel, or may be composite yarn obtained by mixing these fibers, so that part of the thermal melting yarn is melted while leaving the other part remain there. Further, the thermal melting yarn may be mixed yarn in which fiber difficult to thermally melt or which cannot be melted is mixed with fiber which can be thermally melted. Further it is also permissible to use a coated yarn, in which a synthetic fiber having a high melting point or fiber difficult to thermally melt is used as a core yarn and the core yarn is coated with thermoplastic resin having a melting point lower than the core yarn and constituent yarns of the foundation fabric 1 or which is coated with a pipe-like formed resin. If such composite yarn, mixed yarn or coated yarn is employed as the cross-woven warp 7, part of the cross-woven warp remains on the foundation fabric 1 thereby making it possible to improve the cross-weaving strength. The yarns other than the cross-woven warp 7 which is a melting yarn and the warp 10 which is adjacent to the cross-woven warp 7 and thermally melting may be made of cotton or wool.

What is claimed is:

1. A surface fastener woven with warps and wefts comprising an engaging element yarn for forming engaging elements woven into a foundation fabric, wherein a cross-woven warp is cross-woven with said engaging element yarn so that said engaging element yarn is woven in and fixed to the foundation fabric.

2. A surface fastener according to claim 1, wherein the cross-woven warp is cross-woven with the engaging element yarn at before and after the engaging element.

3. A surface fastener according to claim 1, wherein a thermal melting yarn having thermal melting point lower than other constituent yarns is used as said cross-woven warp and welded so as to fix said engaging element yarn to the foundation fabric.

4. A surface fastener according to claim 1, wherein a thermal melting yarn is woven as a warp and welded adjacently to the engaging element yarn and the cross-woven warp so as to fix said engaging element yarn to the foundation fabric.

5. A surface fastener according to claim 3 or 4, wherein composite yarn in which synthetic fiber having a low melting point and synthetic fiber having a high melting point are arranged in parallel or mixed with each other is used as said thermal melting yarn and the synthetic fiber having the low melting point in the thermal melting yarn is welded so as to fix the engaging element yarn to the foundation fabric.

6. A surface fastener according to claim 3 or 4, wherein a mixed yarn in which fiber difficult to melt by heat and fiber capable of being melted by heat are mixed is used as said thermal melting yarn and the fiber capable of being melted by heat in the thermal melting yarn is welded so as to fix the engaging element yarn to the foundation fabric.

7. A surface fastener according to claim 3 or 4, wherein a coated yarn comprised of a core yarn of a fiber having a high melting point or fiber difficult to melt by heat and coating film of thermoplastic resin having a thermal melting point lower than said core yarn provided around said core yarn is used as said thermal melting yarn and the thermoplastic resin having the low melting point of said thermal melting yarn is welded so as to fix the engaging element yarn to the foundation fabric.

* * * * *